United States Patent [19]

Dehart et al.

[11] Patent Number: 4,574,982

[45] Date of Patent: Mar. 11, 1986

[54] METHOD OF RECOVERING INK REMAINING IN AN INK DRUM LINER

[75] Inventors: Michael J. Dehart, Jonesboro, Ark.; Warren C. Spitzner, Kansasville, Wis.; James M. Estes, Graymont, Ill.

[73] Assignee: W. A. Krueger Co., Scottsdale, Ariz.

[21] Appl. No.: 661,315

[22] Filed: Oct. 16, 1984

[51] Int. Cl.[4] ..... B67B 7/24

[52] U.S. Cl. ..... 222/1; 222/102; 414/412

[58] Field of Search ..... 222/102, 1, 82, 83; 414/412

[56] References Cited

U.S. PATENT DOCUMENTS

| | | |
|---|---|---|
| 1,020,321 | 3/1912 | Smith . |
| 1,091,063 | 3/1914 | Hutchinson . |
| 1,228,309 | 5/1917 | Foland . |
| 1,460,204 | 6/1923 | Marafi . |
| 1,913,759 | 6/1933 | Jacobson et al. . |
| 2,013,471 | 9/1935 | Martin . |
| 2,030,579 | 2/1936 | Frazier . |
| 2,840,273 | 6/1958 | McEwen . |
| 3,601,038 | 8/1971 | Hayes . |
| 3,769,896 | 11/1973 | Samuels et al. . |
| 3,866,532 | 2/1975 | Ogden, Jr. . |

*Primary Examiner*—Stanley H. Tollberg
*Attorney, Agent, or Firm*—Dick and Harris

[57] ABSTRACT

A method of recovering ink deposits which remain in the ink drum liner of a substantially empty container which comprises the steps of positioning the mouth end of the drum liner proximate to a roller nip region of wringer assembly structure, inserting the mouth end into the wringer assembly, rotating the wringer assembly so as to draw the liner therethrough while simultaneously urging the ink remaining in the liner towards the closed end as a bulge, pulling the liner through the wringer assembly, opening the closed end of the liner to release the bulge of remaining ink deposits from the closed end of the liner, releasing the accumulated ink deposits from the liner and removing the ink drum liner from said wringer assembly structure. In addition, the method can include: the preliminary operations of stretching, flattening, and folding of the mouth end of the liner; reversing the direction of rotation of the wringer assembly after the release of the remaining ink deposits, and/or scraping off of excess ink residue on the roller members after removal of the liner therefrom. The preferred embodiment of the apparatus for performing the aforementioned method includes hydraulically biased roller members powered by a reversible direction motor. At least one of the roller members is retractable so as to facilitate insertion and release of the drum liner from therebetween.

15 Claims, 12 Drawing Figures

METHOD OF RECOVERING INK REMAINING IN AN INK DRUM LINER

BACKGROUND OF THE INVENTION

The present invention relates in general to devices for expelling substances from collapsible containers and in particular to a method for recovering ink deposits or the like, that remain in a plastic drum liner of a substantially empty container. While apparata have been in existence for discharging of plastic, viscous or semi-fluid materials from flexible containers such as toothpaste tubes and the like, such articles have not addressed the particular concerns surrounding recovering the maximum amount of such substances from the plastic bags or liners customarily used inside the drum-like containers ordinarily used for such substances.

Most devices for expelling substances from collapsible containers, as in E. B. Jacobson et al. U.S. Pat. No. 1,913,759, H. W. McEwen, U.S. Pat. No. 2,840,273, J. W. Frazier, U.S. Pat. No. 2,030,579 and J. S. Martin, U.S. Pat. No. 2,013,471 are designed for dispensing substance from a collapsible tube, such as a toothpaste tube and include a wringer assembly, wherein the tube is interposed between the rollers with one end being affixed to one of the rollers and wound around it as the roller is turned, thereby pushing the contents toward the open end of the tube. In addition, another type of wringer assembly consisting of two oppositely rotating and contacting rollers is shown by Samuels et al, U.S. Pat. No. 3,769,896. In addition, lost-motion mechanisms have likewise been used in connection with wringer assembly apparata for the discharging of the contents of collapsible tubes as shown in C. V. Foland, U.S. Pat. No. 1,228,309. However, these and other wringer assembly devices do not address much less solve the particular problems associated with the recovery of residue ink deposits or the like, remaining in the plastic liner of a substantially empty container thereof.

Accordingly, the present invention has as one of its objects, the provision of a method for facilitated recovery of the substantial amounts of reuseble ink or the like remaining in a plastic drum liner which would otherwise be discarded.

It is additionally an object of the present invention to provide such a method for recovering ink or like that remains in a plastic drum liner in which the process itself is efficient and can be performed if necessary by a single operator, thereby minimizing the economic labor costs associated with the process so as to provide and maintain the cost effectiveness of recovering such material from the liner.

It is further an object of the present invention to provide such a method of recovering ink or the like which remains in a substantially empty plastic drum liner in as safe a manner as possible, while minimizing the risk of injury to the operator.

It is additionally an object of the present invention to provide such a method of recovering a substance from the interior of a plastic drum liner through the use of an apparatus that minimizes the risk of contamination of such recovered substance.

It is further an object of the present invention to provide such a method of recovering a substance from the interior of a plastic drum liner through the use of an apparatus which is inexpensive to construct and maintain, with a minimum of moving parts, as well as deployable in a facilitated manner--all for the purpose of recovering for the purpose of recycling said substance in light of the substantial economic savings associated therewith.

These and other objects of the invention will become apparent in light of the present specification, drawings and claims.

SUMMARY OF THE INVENTION

This invention comprises a method of recovering ink deposits or the like that remain in a drum liner of a substantially empty container and which comprises the steps or operations of: positioning a mouth end portion of the liner at a first open end thereof proximate to a roller nip region of a wringer assembly; inserting the mouth end portion of the liner into the wringer assembly including at least a pair of substantially parallel rollers in operably biased communication relative to each other; rotating the wringer asembly while the rollers are substantially in contact in an engaged position with the liner mouth end, by drive means so as to draw the liner therethrough towards the exit side of the roller means while simultaneously urging the ink deposits remaining in the liner towards the second closed end of the liner as a bulge at the entry side of the roller means; pulling the liner with gripping means proximate the mouth end so as to controllably guide the ink drum liner through the wringer assembly means; opening the closed end of the liner to enable release of the bulge of accumulated ink from the second end of the ink drum liner releasing the accumulated ink from the ink drum liner into collection means; and removing the liner from the wringer assembly.

In addition, the aforementioned method can further comprise the step of reversing the direction of rotation of the roller means after release of the bulge of the remaining contents into collection means, so as to retract the drum liner from the exit side of the roller means and withdraw entirely the liner from the entry side thereof. Similarly, the method can further comprise the operation of preparing of the ink drum liner prior to the aforementioned steps, by among other things, stretching flat and folding the ends of the mouth of the liner prior to the positioning thereof proximate the roller nip position.

The invention can further include the step of scraping of the roller elements of the wringer assembly after removing the liner, so as to scrape off any excess ink deposits that may have collected upon the roller elements.

The preferred embodiment of the apparatus for performing the aforementioned method includes a pair of roller elements in the wringer assembly means which comprises a plurality of substantially parallel roller members operably contained within a frame and operably positioned for rotation by drive means. At least one of the roller members is an upper roller being substantially positioned over a lower rotatable roller member. The upper and lower roller members substantially contact each other proximate to a nip region when in the engaged biased position, so as to enable the liner to be drawn into a position between the roller members towards the exit side of the roller means, while substantially preventing the substance remaining in the liner from passing through the roller members to the exit side thereof. Also, each of the roller elements are operably associated with gear means, so as to result in engaged rotation of the upper lower members in opposite respective directions and corresponding drawing of the liner therethrough between the roller members, thereby accumulating the remaining ink or other substance proximate the closed end of the liner substantially on the entry side of the roller means. In addition, the rollers are disengageable from each other and from their biased position about the liner through disengagement means.

The pair of roller elements in the wringer assembly further comprises at least one of the roller members being translatably mounted within the frame along a direction substantially perpendicular to the axis of rotation of the roller member.

The drive means of the preferred embodiment comprise motor means for providing rotative motion to each of the roller members. Control means are operably connected to the motor so as to enable selective engagement and disengagement of the motor means in either of two desired directions of rotation. Transmission means, operably connected to controls and including gear reducing means, are operably associated with the motor means so as to reduce the rate of rotative motion. Gear means are also operably associated with each of the roller means so as to enable the upper and lower members to be driven in respective opposite directions when the motor means and transmission means are placed into an engaged position by the controls. In this preferred embodiment, the gear means further comprise one or more primary spur gear members operably affixed about the periphery of the lower roller member and one or more corresponding spur gear members operably affixed about the periphery of the roller members so as to mesh with the primary spur gear members on the upper roller member when the roller members are in the engaged position, whereby rotation of the lower roller member will in turn rotate the upper roller member in an opposite respective rotative direction.

The operation of removing the ink drum liner from the wringer assembly means is accomplished in the preferred embodiment through the operation of disengaging biasing means operably connected, to permit alternative activation and deactivation of the wringer assembly into the engaged and disengaged position, to the roller member portion of the wringer assembly through activation means. The biasing means selectively serve to maintain the roller members in the engaged position and permit separation of the roller members so as to facilitate extraction of the drum liner from therebetween, when in the disengaged position.

The biasing means further comprise piston means being operably affixed to the frame and including one or more extendable piston arms. A collar member is attached to a first end of one or more of the piston arms and a collar member is also operably attached to one or more of the translatable upper and lower roller members. Hydraulic cylinder means are also provided in the preferred embodiment in operably associated fashion with the second end of one or more of the piston arms so as to selectively extend and retract the piston arms and in turn be translatable roller members, thereby respectively placing the rollers into the engaged biased position or providing access to the liner therebetween substantially along the entire length of the upper and lower roller members.

In the preferred embodiment of the process described herein, the operation of opening the closed end of the liner to release the bulge of the substance remaining within the plastic is accomplished by sliting the closed end thereof, so as to puncture the liner and permit the bulge of remaining substance to flow out thereat into collection means.

The gripping means used in the aforementioned method to pull the liner and guide it through the wringer assembly can also comprise a manually operable gripping element. The aforementioned motor means can comprise, in the preferred embodiment, a reversible direction electric motor. In addition, in the preferred embodiment the control means comprises a three-way foot pedal switch operably connected to the input portion of the motor means so as to enable the selection of either a forward or reverse direction of rotation of the roller members as well as stoppage thereof or leaving an operator's hands free for other operations. Furthermore, the operation of slitting the closed end of the ink drum liner is accomplished through a knife element capable of firstly puncturing and then slitting said liner in a direction substantially parallel to the longitudinal axis of the roller elements.

BRIEF DESCRIPTION OF THE DRAWINGS

FIG. 1 is a side cross sectional view of the roller members showing them in an open or disengaged position, prior to positioning of the liner proximate thereto.

FIG. 2 illustrates the step of inserting the mouth end of the drum liner between the roller members while they are in the open or disengaged position.

FIG. 3 illustrates the step of rotating the roller members which are in a closed and engaged position, in opposite respective directions with the drum liner interposed therebetween.

FIG. 4 illustrates the step of pulling the drum liner by gripping means while roller members are in an engaged and rotating position with the drum liner interposed therebetween.

FIGS. 5 and 6 illustrate continued pulling of the liner while the roller members are in an engaged position and continue rotating in opposite respective directions so as to urge the drum liner to pass from the entry side to exit side thereof, while forming the bulge of remaining substance proximate the closed end of the drum liner.

FIGS. 7 and 8 illustrate the steps of opening of the closed end of the liner proximate the bulge of remaining substance by puncturing the liner with cutting means and releasing and allowing the substance contained therein to flow out of the liner and into a receptacle, while the roller members continue to rotate in opposite respective directions.

FIG. 9 illustrates the steps of removing the ink drum liner from between the rollers of the wringer assembly means while the rollers are disengaged or separated so as to facilitate the withdrawal of the drum liner therefrom.

FIG. 10 illustrates the step of scraping off of any excess ink residue that may have accumulated on the roller members.

Figure 1:
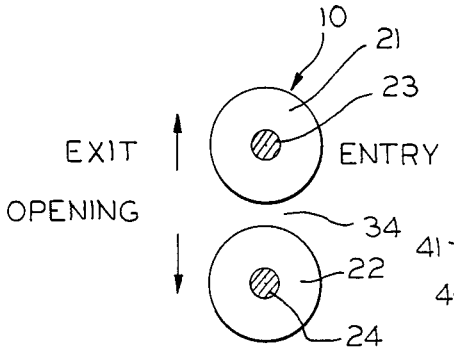
FIGS. 1 through 10 are illustrations of the various steps which can comprise the described method of recovering ink or a similar substance that remains in a plastic drum liner of a substantially empty container.

11 and viewed in the direction of the arrows, showing in particular the roller members in a disengaged unbiased position and having their respective spur gears disengaged, as well as showing the frame upon which the hydraulic air cylinder, piston arm, collar and motor and transmission means are mounted.

DETAILED DESCRIPTION OF THE DRAWINGS

While this invention is susceptible of embodiment in many different forms, it is shown in the drawings and will herein be described in detail, one specific embodiment, with the understanding that the present disclosure is to be considered as an exemplification of the principles of the invention and is not intended to limit the invention to the embodiments illustrated.

The present invention concerns a method for recovering deposits of ink or any such similar substance that may remain in the plastic liner 40 of a drum-like container which at one time was filled with said substance and which would otherwise be discarded. FIGS. 1 through 9 illustrate the various steps comprising the aforementioned method of recovering said substance, which in the preferred embodiment is ink, though the scope of this invention is certainly not limited to any substance in particular. As shown in FIG. 1, wringer assembly 10 includes upper roller member 21 surrounding shaft 23, positioned upon substantially parallel lower roller member 22 which surrounds and is operably affixed to corresponding central shaft 24. Once the wringer assembly is in the disengaged or open and unbiased position, as shown in FIG. 1, the roller members 21 and 23 are separated and nip region 34 is enlarged so as to facilitate access thereto. Likewise, with respect to FIG. 1, the exit side of wringer assembly 10 is to the left thereof while the entry side of wringer assembly 10 is to the right thereof.

Figure 2:
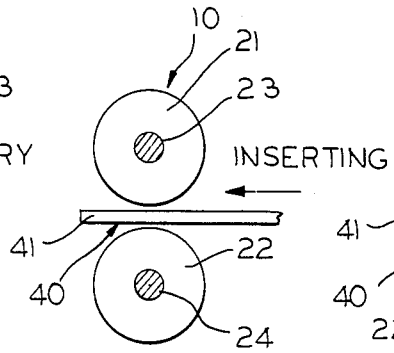
Figure 3:
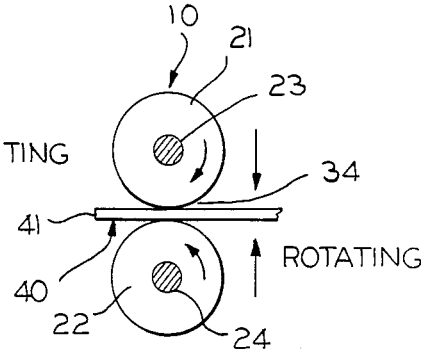

The preferred method can commence by the operation of holding and positioning the first mouth end portion 41 of the drum liner 40 and inserting it into region 34 between upper roller member 21 and lower roller member 22, while they are in the opened or disengaged position, as shown by FIGS. 1 and 2. As shown in FIG. 3, roller members 21 and 22 are then rotated in opposite respective directions, while in the closed or engaged and biased position, wherein roller members 21 and 22 are brought into contact with liner 40 therebetween. As the roller members 21 and 22 are rotated in opposite respective directions, the liner 40 will be drawn towards the exit side of roller means 10 as it passes between the rollers 21 and 22 while simultaneously the ink deposits remaining in the liner are urged towards the second closed end 44 of liner 40, since the ink will not be allowed to pass between the rollers 21 and 22.

Figure 6:
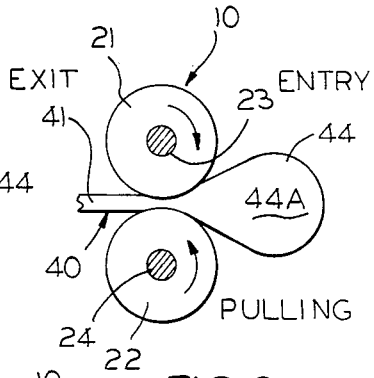

As shown in FIG. 6, the primary result of liner 40 passing between and being squeezed by rollers 21 and 22 to the exit side of roller means 10, is that any ink within the liner 40 will remain on the entry side of roller means 10 since such ink will be squeezed by rollers 21 and 22 at the entry side of nip region 34 and urged towards closed end 44, so as to substantially accumulate as a bulge 44A, as the volume of the portion of liner 40 remaining on the entry side of roller means 10, continues to decrease as a result of the liner 40 being increasingly pulled and drawn onto the exit side of roller means 10.

Figure 4:
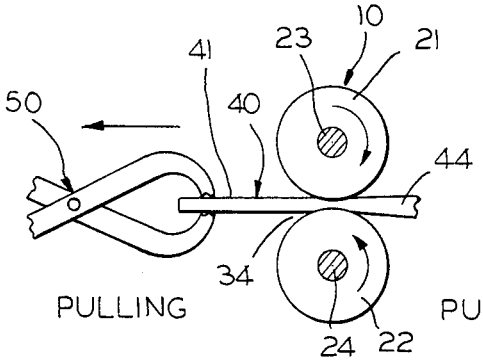
Figure 5:
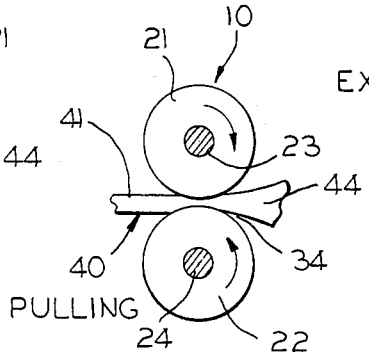
Figure 7:
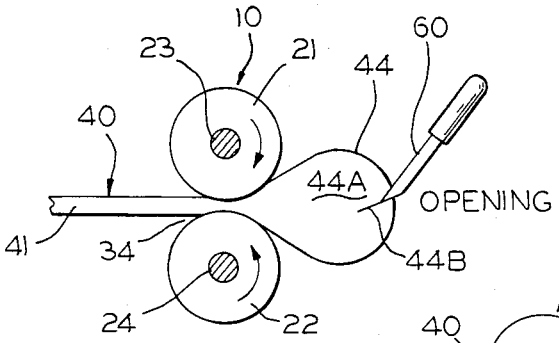
Figure 8:
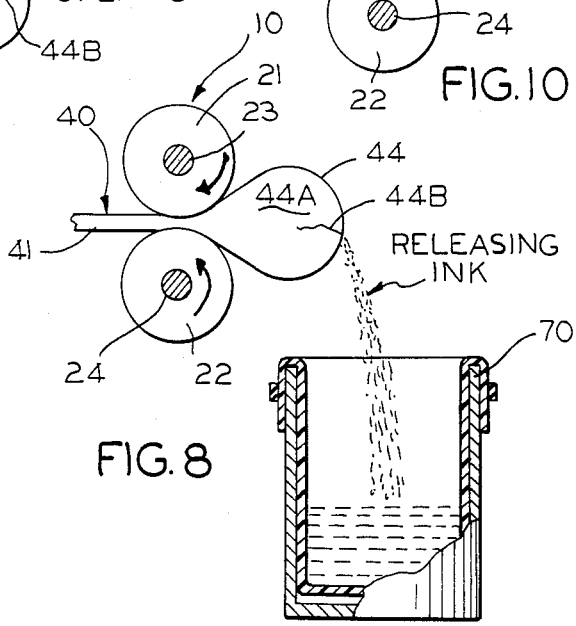

While rollers 21 and 22 continue to rotate in opposite respective directions so as to draw liner 40 therebetween and onto the exit side of roller means 10, as shown in FIGS. 4 through 6, liner 40 is pulled by gripping means 50, (which can either be a user's hands or a hand operated gripping tool such as a pair of pliers,) proximate the mouth end 41 of liner 40, so as to guide the liner 40 through the wringer assembly means 10. As shown in FIGS. 4 through 6, bulge 44A at closed end 44 of liner 40, will continue to increase in size as liner 40 continues to pass between the rollers and be pulled from the exit side of wringer assembly 10, and while the wringer assembly means continues to rotate while in the engaged position. Once bulge 44A of liner 40 reaches a desired size, the liner is opened and the ink deposits remaining therein are removed, as shown in FIGS. 7 and 8 by applying cutting means 60, (a knife or the like,) to bulge 44A of liner 40 so as to slit the liner 40 at puncture 44B in a direction substantially parallel to the longitudinal axis of the roller means 10 and allow the ink contained therein to be released therefrom and flow out and into a receptacle positioned therebelow for possible reuse, such as drum-like cylinder 70 as roller members 21 and 22 continue to rotate. In addition, once the remaining ink is substantially released from the interior of the liner 40, the liner 40 can then be removed from wringer assembly means 10, as shown by FIG. 9 by disengaging roller members 21 and 22, so as to provide a separation at nip region 34 and facilitate pulling liner 40 out of wringer assembly 10.

Furthermore, alternatively the aforementioned method can include the operation of reversing the direction of rotation of roller members 21 and 22 after release of the ink deposits from within bulge 44A of liner 40 to collection means 70, so as to retract some or all of the portion of liner 40 from the exit side of wringer assembly means 10 to the entry side thereof, and withdraw entirely the ink drum liner from the entry side of wringer assembly means 10 prior to its removal.

In operation, the drum liner 40 can be prepared for the foregoing process, by the following operation. Firstly, the substantially emptied barrel of ink is unlocked and opened. The drum liner 40 is then opened and folded around the outside of the drum. The "skim" sheet, a plastic sheet inside the liner bag, is then removed and discarded. Tape can then be applied to the outside of the drum to secure the plastic liner to the side thereof prior to its removal therefrom. Thereafter, both edges at the mouth end 41 of liner 40 are then flattened, stretched and folded towards the center of the liner mouth end 41. Mouth end 41 of liner 40 can then be inserted between roller members 21 and 22 thereby commencing said process.

Figure 9:
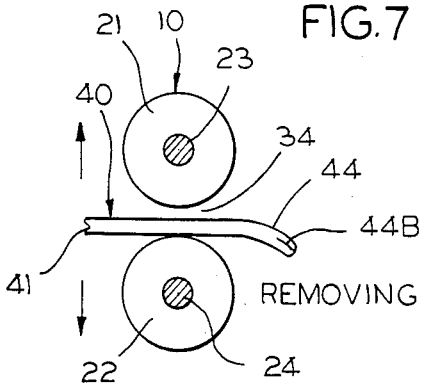

After the ink is released from drum liner 40, as shown in FIGS. 7 and 8 by cutting and continued squeezing of liner bulge 44A, and removal of liner 40 (as shown in FIG. 9) is accomplished, scraping means 67, such as an ink knife or other such scraping utensil, can be applied to roller members 21 and 22 in order to scrape off any excess ink that may have inadvertently collected on rollers 21 and 22 during the above-described process.

Figure 11:
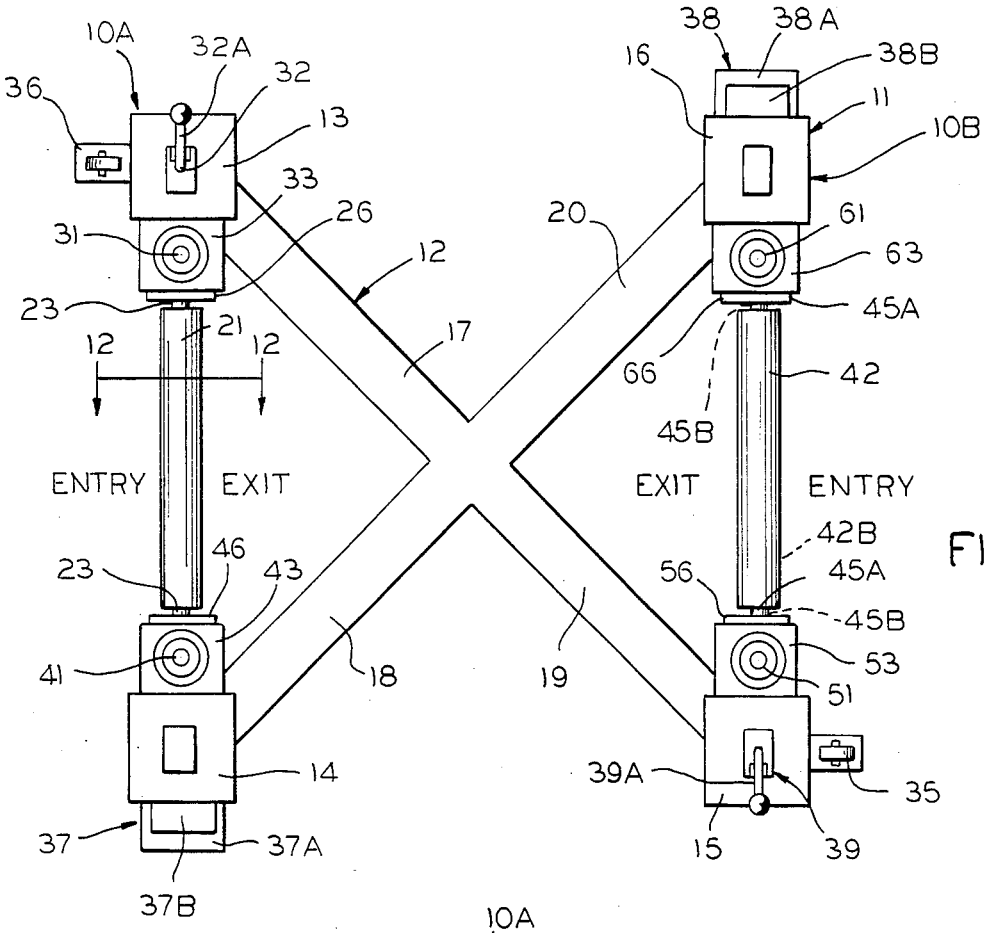
FIG. 11 is a top planer view of the preferred embodiment showing the dual, wringer assembly construction thereof and in particular the roller members, hydraulic air cylinders, control means, support struts, vertical columns, frames and the exit and entry sides of each wringer assembly.
Figure 12:
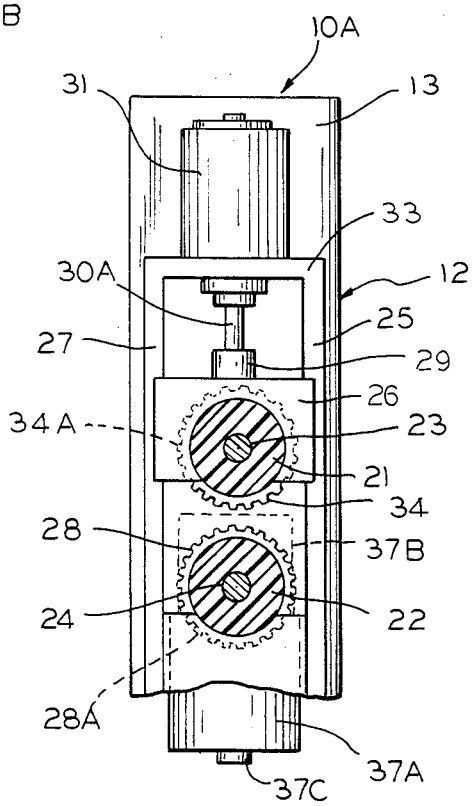
FIG. 12 is a partial side cross sectional view of one of the wringer assemblies taken along line 12—12 of FIG.

The preferred embodiment of a particular apparatus capable of carrying out the aforementioned method, is shown in FIGS. 11 and 12. Squeezer device 11 comprises frame 12 including vertical columns 13, 14, 15 and 16 as well as lateral struts 17, 18, 19 and 20 securely attached thereto so as to provide a secure supporting structure for the twin wringer assemblies 10A and 10B of the preferred embodiment. As shown in FIG. 11, the preferred embodiment of squeezer device 11 provides for a dual wringer assembly 10A and 10B construction, though alternative configurations of frame 12 supporting any number of one or more wringer assemblies should be considered as being within the scope of the present invention.

As further shown in FIG. 11, affixed to and spanning vertical columns 13 and 14 is wringer assembly 10A which includes drive means 37 including motor means 37A, transmission means 37B and output shaft 37C, operably affixed to gear means 34 and 28 which are in turn operably affixed to upper roller member 21 and lower roller member 22 respectively. As shown in FIG. 12, roller members 21 and 22 are positioned with upper roller member 21 being positioned above lower roller member 22 in a substantially parallel arrangement. Central shafts 23 and 24 of roller members 21 and 22, respectively, are securely affixed thereto.

Upper roller member central shaft 23 of wringer assembly 10A is rotatably mounted to collars 26 and 46. Lower roller member central shaft 24 at one end is operably affixed to transmission means 37B, which in turn is operably associated with the output portion of drive means 37. The opposite end of lower roller member central shaft 24 is rotatably affixed to frame 13. Motor means 37A, in the preferred embodiment serves to provide rotation of drive means output shaft 37C about an axis that is approximately vertical, as viewed in FIG. 12. In turn, transmission means 37B including a gear reduction mechanism, is operably connected to the output shaft 37C of motor means 37A so as to change the axis of rotation of the aforementioned rotative motion to the substantially horizontal direction of upper roller central shaft 23, as shown in FIG. 12 as well as to reduce the speed of rotation thereof.

Motor means 37A in the preferred embodiment consists of a bi-directional electric motor, though other types of drive means are considered within the scope of the present invention. In the preferred embodiment as shown in FIGS. 11 and 12, the aforementioned gear means include substantially circular upper spur gear member 34 and lower spur gear member 28 each of which is concentricly provided about the periphery of upper roller members 21 and 22, respectively, proximate one end thereof. When roller members 21 and 22 are in the engaged position, the respective spur gear teeth 34A and 28A of spur gear 34 and 28, mesh so as to result in rotation of upper roller member 21 in an opposite respective direction in response to rotation of lower roller member 22 by drive means 37A and transmission means 37B. When engagement of spur gears 34 and 28 is sought, it may be necessary to momentarily activate motor means 37A so as to obtain proper meshing of the teeth 34A and 28A of gears 34 and 28.

In the preferred embodiment, lower roller member central shaft 24 is actually the output shaft of transmission means 37B so as to be directly rotatively driven thereby, through other configurations of transmission means associated with roller members, so as to transmit rotative movement thereto are considered to be within the scope of the invention. Also shown in FIG. 11 is control means 36, which in the preferred embodiment comprises a three-way foot pedal switch connected to the input portion of motor means 37A, so as to either activate forward rotation, signal cessation of the rotation or activate a reversal of the rotative direction of motor means 37A and in turn the roller members 21 and 22, depending upon the position of the foot pedal switch 36. In addition, foot pedal switch 36 can be provided with a guard above the three-position switch portion thereof requiring the intentional insertion of the operator's foot therebetween, in order to selectively activate said switch 36, and thereby reducing the risk of any inadvertent activation thereof, such as, for example, when an operator's hands are between or near the roller 21 and 22 or wringer assembly 10A.

As further shown in FIG. 11, upper roller member 21 is rotatably mounted to collar 26 which is capable of sliding substantially vertically upon tracks 25 and 27 formed upon inner frame 33. FIG. 11 shows wringer assembly 10A in the disengaged position, with the separation between roller members 21 and 22 proximate the nip region 34 being at its maximum. Optimally, the nip region 34 separation should be approximately 1" when wringer assembly is in the disengaged position. Collar 26, as shown in FIG. 11, is operably connected to sleeve 29 which in turn is affixed to extendable piston arm 30A. Piston arm 30A in turn is operably associated with hydraulic air cylinder 31. Hydraulic air cylinders 31 and 41 and in turn piston arms 30A and 30B (not shown) serve to exert a substantially constant downward biasing force along upper roller members 21 and 22 along their lengths when engaged. Alternatively, compression springs can be substituted for said hydraulic air cylinders 31 and 41 to provide said downward biasing force.

Activation means 32 including lever 32A serve to simultaneously activate hydraulic air cylinders 31 and 41 so as to extend piston arms 30A which in turn cause collars 26 and 46 and resultingly upper roller member 21 to correspondingly slide downwards along tracks 25 and 27 so as to bring upper roller member 21 substantially into contact with lower roller member 22, which in the preferred embodiment is stationary and securely and rotatably affixed to frame 33, which is in turn affixed to vertical column 13. It should, however, be considered as being within the scope of the present invention to instead slideably mount lower roller member 22 onto frame 33. While roller members 21 and 22 are in the engaged position, the throwing of lever 32A of activation means 32 in the opposite direction serves to cause air cylinders 31 and 41 to hydraulically retract piston arms 30A and 30B (not shown) and in turn retract collars 26 and 46 and upper roller member 21 affixed thereto, to the disengaged position so as to once again increase the separation between the roller members at nip region 34 as shown in FIG. 11 and provide access to liner 40 therebetween substantially along the entire length of upper and lower roller elements 21 and 22. In wringer assembly 10A, in the preferred embodiment, corresponding hydraulic air cylinder 41 is similarly attached to collar 46 and roller member 21 so as to accomplish the aforementioned extension or retraction of upper roller member 21 from the disengaged, (unbiased) or engaged, (biased) position, respectively, upon activation by lever 32A of activation means 32.

Similarly, second wringer assembly 10B of the preferred embodiment is constructed and operates in the same manner as roller assembly 10A and is arranged in "mirror image" configuration thereto. Specifically, drive means 38, consisting of motor means including a bi-directional electric motor 38A, in the preferred embodiment, is operably affixed to vertical column member 16. Motor means 38A are also similarly operably affixed to transmission means 38B. Roller member central shafts 45A and 45B (not shown) which span between vertical column 16 and vertical column 15, have upper roller member 42A and lower roller member 42B (not shown) securely affixed thereto in a substantially surrounding fashion. As described for wringer assembly 10A, lower central shaft member 45B and in turn lower roller member 42B, in the preferred embodiment are directly driven by transmission means 38B, while in turn causing the driving of upper central shaft member and upper roller member 42A in the opposite respective direction when in the engaged position. Collars 56 and 66 of upper roller member 42 are likewise substantially vertically slideably mounted within the tracks 63 and 53 of vertical column 16. Lower central shaft member 45B is likewise operably connected drive means 38 and is operably connected by gear means to upper roller member 42 and upper shaft 45A. Activation means 39 including control lever 39A serves to activate hydraulic air cylinders 51 and 61 to bring upper roller member 42A into the engaged and substantially contacting position with lower roller member 42B, so as to exert a substantially uniform downwardly biasing force along roller members 42A and 42B, in the above-described manner. Likewise, moving of lever 39A in the opposite direction serves to activate hydraulic air cylinders 51 and 61 so as to disengage said wringer assembly 10B by retracting upper roller member 42A from lower roller member 42B and thereby increasing the gap or separation therebetween, proximate nip region 34. Alternatively, compression springs may be substituted for hydraulic air cylinders 51 and 61 in order to provide the downward biasing force. As with wringer assembly 10A, foot pedal control 35 in the preferred embodiment is a three position switch, wherein one of said positions activates drive means 38A and forward rotation of roller members 42A and 42B, where a second position stops rotation thereof and a third position results in rotation of said roller members 42A and 42B in a reverse direction.

Figure 10:
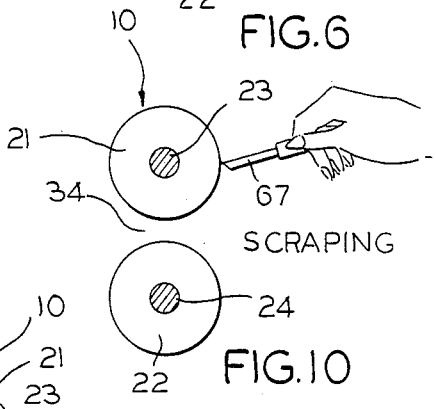

In operation, and with respect to FIGS. 11 and 12, the preferred embodiment operates as follows. With respect to wringer assembly 10A, lever 32A of activation means 32 is thrown so as to disengage upper roller member 21 from lower roller member 22 and provide the maximum separation of the two roller elements 21 and 22 at nip region 34 (optimally approximately 1") so as to facilitate insertion of open mouth end 41 of drum liner 40 (not shown in FIGS. 10 and 11) therebetween. Lever 32A of activation means 32 is then closed so as to cause hydraulic air cylinders 31 and 41 to hydraulically extend piston arms 30A and 30B, and in turn cause collars 26 and 46 to slide substantially downwardly along frames 33 and 43, respectively, so as to close the gap at nip region 34 between roller members 21 and 22, and bring the roller members into a substantially touching relation at nip region 34 while applying a downward biasing force thereon with drum liner 40 interposed therebetween.

As shown in FIG. 11, the left hand side of wringer assembly 10A is referred to as the entry side of roller members 21 and 22, while the right hand side thereof is correspondingly referred to as the exit side of roller members 21 and 22. Drum liner 40 is then inserted between the roller members 21 and 22 from the entry side of wringer assembly 10A and extends through and out from between roller members 21 and 22 onto the exit side of wringer assembly 10A. When drive means 37A is activated by foot pedal control means 36 so as to rotate roller members 21 and 22 in the forward direction, said roller members 21 and 22 will rotate in opposite respective directions, as shown in FIGS. 3 through 7, (while being downwardly biased by hydraulic air cylinder assemblies 51 and 61) so as to serve to urge liner 40 from the entry side of wringer assembly 10A to the exit side thereof. Foot pedal control means 36 can likewise be provided with a guard shield thereover, to minimize the risk of inadvertent activation thereof. Such forward rotation of roller members 21 and 22 while in the engaged position, as described above, serves to allow drum liner 40 to pass between roller members 21 and 22 while the ink deposits or other substance remaining therein substantially remain on the entry side of roller members 21 and 22 and are urged towards the second closed end 44 of liner 40.

As shown in FIGS. 5 through 7, as more of drum liner 40 passes to the exit side of roller members 21 and 22, the remaining ink deposits or other substance continues to occupy an increasingly smaller amount (by volume) of drum liner 40, so as to result in bulge 44A being formed on the entry side of wringer assembly 10A, proximate the closed end 44 of drum liner 40. As shown in FIGS. 7 and 8, when bulge 44A reaches a desireable size, cutting means 60, (in the preferred embodiment, a knife or other pointed or sharp object) is used to puncture the closed end 44 of liner 40 so as to permit the bulge 44A of remaining ink within liner 40 to flow through puncture 44B and into receptacle 70 positioned proximately thereunder on the entry side of wringer assembly 10A.

Once the bulge 44A of remaining ink is removed from liner 40, lever 32A can then be opened so as to disengage roller member 21 from roller member 22 (and their respective spur gears) and increase the separation therebetween at nip region 34 so as to facilitate removal of the now spent drum liner from therebetween. Prior to disengagement of roller members 21 and 22, foot pedal control means 36 may be employed to reverse the direction of rotation of roller members 21 and 22 so as to draw the drum liner 40 from the exit portion of wringer assembly 10A to the entry portion thereof, prior to removal of the liner from the wringer assembly means 10A. In addition, scraping means 67, (such as an ink knife or other scraper-like device,) can then be applied to roller members 21 and 22 in order to scrape off any excess ink or ink residue that may have collected on roller members 21 and 22 during the operation thereof.

Wringer assembly means 10B of the preferred embodiment likewise operates in the above-described manner. The dual wringer assembly construction of the preferred embodiment, not only allows simultaneous performance of the foregoing ink recovery process upon two ink drum liners, by two operators, but also reduces the risk of contamination of the ink recovered thereby, from any ink residue of a different type or color remaining on the wringer assemby from a prior operation thereof, by facilitating exclusive dedication of a wringer assembly to a particular type or color of ink.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A method of recovering deposits of ink that remain in the ink drum liner of a substantially empty container, which comprises the steps of:

positioning a mouth end portion of said ink drum liner at a first open end of said liner proximate to a roller nip region of wringer assembly means;

inserting said mouth end portion of said liner into the roller means portion of said wringer assembly means;

said roller means comprising at least a pair of roller elements in operable biased communication relative to each other having a first entry side at said nip region, and an exit side opposite to said entry side;

rotating said roller means of said wringer assembly means while in engagement with said mouth end portion by drive means so as to draw said liner therethrough towards an exit side of said roller means while simultaneously urging said ink-deposits in said liner towards the closed end of said liner at a second opposite end, as a bulge on said entry side of said roller means;

pulling said liner with gripping means, proximate said open mouth end so as to controllably guide said ink drum liner through said wringer assembly means;

opening the closed end of said liner proximate to said second end to enable release of said accumulated ink deposits and said bulge from said second end of said ink drum liner;

releasing the accumulated ink deposits from said ink drum liner into collection means positioned below said opened second end of the ink drum liner; and removing said ink drum liner from said wringer assembly means.

2. The invention according to claim 1 wherein said method further comprises the operation of reversing the direction of rotation of said roller means after said release of said bulge of remaining ink deposits into said collection means, so as to retract said ink drum liner from the exit side of said roller means and entirely withdraw said ink drum liner from said entry side thereof.

3. The invention according to claim 1 wherein said method further comprises the operations of stretching flat the open mouth end, portion of said ink drum liner and folding over the ends of said open mouth end portion prior to positioning said mouth end and portion of said ink drum liner proximate to the roller nip region of said roller means portion of said roller means portion in said wringer assembly means.

4. The invention according to claim 1 wherein said method further comprises the operation of scraping of said roller elements after removing said ink liner, so as to scrape off any excess ink deposits that may have collected upon said roller elements.

5. The invention according to claim 1 wherein said pair of roller elements in said wringer assembly means comprises:

a plurality of substantially parallel roller members operably contained within frame means and operably positioned for rotation by said drive means;

at least one of said roller members comprising an upper rotatable roller being substantially positioned over a lower rotatable roller member;

said upper and lower roller members substantially contacting each other proximate to said nip region, when in said engaged biased position, so as to enable said liner to be drawn into a position between said roller members towards said exit side of said roller means, while substantially preventing said remaining ink deposits from passing through said roller members to said exit side thereof;

each of said roller members being operably associated with gear means, so as to result in engaged rotation of said upper and lower roller members in opposite respective directions and corresponding drawing of said liner therethrough between said roller members, thereby accumulating said remaining ink deposits proximate said closed end of said liner substantially on said entry side of said roller means; and said rollers being disengaged from each other and from their biased position about said ink drum liner through disengagement means.

6. The invention according to claim 5 wherein said pair of roller elements in said wringer assembly further comprises at least one of said roller members being translatably mounted within said frame means along a direction substantially perpendicular to the axis of rotation of said roller member.

7. The invention according to claim 5 wherein said drive means comprises:

motor means for providing rotative motion to each of said roller members control means operably connected to said motor means so as to enable selective engagement and disengagement of said motor means in either of two desired directions of rotation, transmission means operably connected to said control means and including gear reducing means operably interposed between said motor means and one or more of said roller members to reduce the rate of said rotative motion, and gear means being operably associated with each of said roller means so as to enable said upper and lower roller members to be driven in said respectively opposite directions when said motor means and transmission means are placed in an engaged position by said control means.

8. The invention according to claim 7 wherein said gear means further comprises:

one or more primary lower one of spur gear members operably affixed about the periphery of said roller members; and one or more corresponding spur gear members operably affixed about the periphery of the upper one of said roller members so as to mesh with said primary spur gear members on said lower roller member when said upper and lower members are in said engaged position, whereby rotation of said lower roller member will in turn rotate said upper roller member in an opposite respective rotative direction.

9. The invention according to claim 5 wherein the operation of removing said ink drum liner from said wringer assembly means is accomplished through the operation of disengaging the biasing means operably connected to said roller members in said wringer assembly means through activation means operably associated with said biasing means so as to permit alternative activation of said wringer assembly into said engaged position and deactivation of said wringer assembly into said disengaged position; and said biasing means in said engaged mode serving to maintain said upper and lower roller members biased towards one another so as to facilitate extraction of said ink deposits from said ink drum liner positioned therebetween.

10. The invention according to claim 9 wherein said activation means further comprises:

piston means being operably affixed to said frame;

said piston means including one or more extendable piston arms;

a collar member attached to a first end of said one or more piston arms;

said collar member further being operably attached to one or more of said upper and lower roller members; and one or more hydraulic cylinder means operably associated with a second end of said one or more piston arms so as to selectively extend and retract said piston arms and in turn retract said translatable roller members, thereby respectively placing said roller members into said engaged biased position and alternatively disengaging same to provide access to said liner therebetween, substantially along the entire length of said upper and lower roller members.

11. The invention according to claim 1 wherein the operation of opening the closed end of said ink drum liner to release said ink deposits and bulge is accomplished by slitting the closed end of said ink drum liner, so as to permit said ink deposit bulge of remaining ink to flow out into said collection means.

12. The invention according to claim 1 wherein said gripping means comprise a manually operable gripping element.

13. The invention according to claim 7 wherein said motor means comprise a reversible direction electric motor.

14. The invention according to claim 7 wherein said control means comprises a three-way foot pedal switch operably connected to said input portion of said motor means so as to enable the selection of the direction of rotation of said roller members, as well as reversal and stoppage thereof while leaving an operator's hands free for other operations.

15. The invention according to claim 11 wherein said operation of slitting the closed end of the ink drum liner is accomplished through a knife element capable of firstly puncturing and then slitting said liner in a direction substantially parallel to the longitudinal axis of said roller elements.

* * * * *

UNITED STATES PATENT AND TRADEMARK OFFICE

CERTIFICATE OF CORRECTION

PATENT NO. : 4,574,982

DATED : March 11, 1986

INVENTOR(S) : Michael J. Dehart, Warren C. Spitzner and James M. Estes

It is certified that error appears in the above-identified patent and that said Letters Patent is hereby corrected as shown below:

| | |
|---|---|
| Col. 1, line 23 | "substance" should be -- a substance -- |
| Col. 2, line 18 | "asembly" should be -- assembly -- |
| Col. 5, line 41 | "region 34" should be -- nip region 34 - |
| Col. 8, line 8 | "roller" should be -- rollers -- |

Signed and Sealed this

*Tenth* Day of *June 1986*

[SEAL]

*Attest:*

DONALD J. QUIGG

*Attesting Officer*

*Commissioner of Patents and Trademarks*